US011596170B2

(12) United States Patent
Boucher et al.

(10) Patent No.: US 11,596,170 B2
(45) Date of Patent: Mar. 7, 2023

(54) CONE STAGING APPARATUS AND RELATED METHODS

(71) Applicant: CANOPY GROWTH CORPORATION, Smiths Falls (CA)

(72) Inventors: Luc Boucher, Ottawa (CA); Mike Sirois, Ottawa (CA)

(73) Assignee: CANOPY GROWTH CORPORATION, Smiths Falls (CA)

( * ) Notice: Subject to any disclaimer, the term of this patent is extended or adjusted under 35 U.S.C. 154(b) by 641 days.

(21) Appl. No.: 16/391,434

(22) Filed: Apr. 23, 2019

(65) Prior Publication Data

US 2019/0320708 A1 Oct. 24, 2019

Related U.S. Application Data

(60) Provisional application No. 62/810,010, filed on Feb. 25, 2019, provisional application No. 62/810,017, filed on Feb. 25, 2019, provisional application No. 62/809,998, filed on Feb. 25, 2019, provisional application No. 62/661,348, filed on Apr. 23, 2018.

(51) Int. Cl.

| | |
|---|---|
| ***A24C 5/06*** | (2006.01) |
| ***A24C 5/54*** | (2006.01) |
| ***A24C 5/12*** | (2006.01) |
| ***A24C 5/44*** | (2006.01) |

(52) U.S. Cl.

CPC ..... *A24C 5/06* (2013.01); *A24C 5/12* (2013.01); *A24C 5/44* (2013.01); *A24C 5/54* (2013.01)

(58) Field of Classification Search

None

See application file for complete search history.

(56) References Cited

U.S. PATENT DOCUMENTS

| | | | | |
|---|---|---|---|---|
| 2007/0000688 | A1 | 1/2007 | Hicks | |
| 2014/0319163 | A1* | 10/2014 | Lukhaub | G01N 35/025 221/1 |
| 2016/0120212 | A1 | 5/2016 | Heidtmann | |
| 2016/0235113 | A1 | 8/2016 | Henley | |

FOREIGN PATENT DOCUMENTS

| | | | |
|---|---|---|---|
| WO | 02056714 | A1 | 7/2002 |
| WO | 2017/172844 | A1 | 5/2017 |

OTHER PUBLICATIONS

International Search Report and Written Opinion issued in PCT/CA2019/050498, dated Jul. 3, 2019, 8 pages.

* cited by examiner

*Primary Examiner* — Kelly M Gambetta
*Assistant Examiner* — Katherine A Will
(74) *Attorney, Agent, or Firm* — Stinson LLP

(57) ABSTRACT

A cone staging apparatus for production of smoking articles includes (a) a frame, and (b) a cone pallet releasably supported by the frame. The cone pallet includes a plurality of cavities. Each cavity has an open upper end for receiving a cone therein. The apparatus further includes (c) a cone magazine adjacent the frame for holding a supply of cones. The cone magazine includes at least one escapement alignable over the open upper end of a respective cavity of the cone pallet to facilitate transferring a single cone from the supply of cones to the respective cavity.

17 Claims, 9 Drawing Sheets

CONE STAGING APPARATUS AND RELATED METHODS

CROSS-REFERENCE TO RELATED APPLICATIONS

This application is based on and claims priority to U.S. Provisional Application Ser. No. 62/661,348 filed Apr. 23, 2018; U.S. Provisional Application Ser. No. 62/809,998 filed Feb. 25, 2019; U.S. Provisional Application Ser. No. 62/810,010 filed Feb. 25, 2019; and U.S. Provisional Application Ser. No. 62/810,017 filed Feb. 25, 2019, each of which is incorporated herein by reference in its entirety.

STATEMENT REGARDING FEDERALLY SPONSORED RESEARCH OR DEVELOPMENT

Not applicable.

STATEMENT REGARDING JOINT RESEARCH AGREEMENT

Not applicable.

BACKGROUND OF THE INVENTION

1. Field of the Invention

The specification relates generally to production of smoking articles, and more specifically, to apparatuses and methods for staging cones in production of conical smoking articles.

2. Description of Related Art

Int. Pub. No. WO 2017/172844 A1 discloses an apparatus including a holder plate and a carriage assembly. The holder plate includes a plurality of through-holes configured to receive containers having an interior cavity. The carriage assembly comprises one or more carriage plates and tamper rods, the carriage plates having a plurality of through-holes. Each of the tamper rods can be slidably disposed in a respective one of the plurality of through-holes of the carriage plate. Each of the tamper rods can be independently weighted to provide a force independent of the other of the tamper rods and can be independently movable relative to the other of the tamper rods. The carriage assembly can be configured to be aligned with the holder plate such that the each of the tamper rods provides a compressive force to a filler material within the interior cavity of each of the containers.

U.S. Pat. App. Pub. No. 2016/0120212 A1 discloses a tube filling apparatus. The apparatus includes a base and a filling assembly mountable on the base. The filling assembly has a number of tube receiving recesses wherein tubes may, in use, be received. The apparatus further includes a vibration plate which is locatable between the base and the filling assembly. In use, the tubes rest on the vibration plate when they are located in the recesses. The apparatus also includes vibrating means which is connected to the vibration plate for, in use, vibrating the vibration plate, which is capable of moving independently from the filling assembly.

BRIEF SUMMARY OF THE INVENTION

The following summary is intended to introduce the reader to various aspects of the applicant's teaching, but not to define any invention.

According to some aspects, a cone staging apparatus for production of smoking articles includes: (a) a frame; and (b) a cone pallet releasably supported by the frame. The cone pallet includes a plurality of cavities. Each cavity has an open upper end for receiving a cone therein. The apparatus further includes (c) a cone magazine adjacent the frame for holding a supply of cones. The cone magazine includes at least one escapement alignable over the open upper end of a respective cavity of the cone pallet to facilitate transferring a single cone from the supply of cones to the respective cavity.

In some examples, the at least one escapement includes a first escapement and a second escapement, the first and second escapements alignable simultaneously over the open upper ends of a first cavity and a second cavity, respectively, of the plurality of cavities.

In some examples, the quantity of the escapements is equal to the quantity of the cavities of the cone pallet.

In some examples, the cavities are arranged in a geometric pattern. In some examples, the geometric pattern is a circular array. In some examples, the geometric pattern is rectangular array or grid, for example, 50 cavities arranged in a 10×5 grid.

In some examples, the pallet comprises a pallet body, and the cavities are of unitary, integral construction with the pallet body. In some examples, the pallet comprises a pallet body, and each cavity is defined by an inner surface of a respective nest, the nests removably secured to the pallet body.

In some examples, the single cone is, prior to transfer, a lowermost cone of the supply of cones, and the escapement is configured to apply a retaining force against the lowermost cone to prevent unwanted release of the lowermost cone from the supply of cones.

In some examples, the magazine includes at least one tube having a tube diameter sized for slidably receiving a stack of the cones in sliding fit, and the escapement includes at least one restricting member protruding radially inwardly of the tube diameter for engaging a lowermost cone of the stack of cones.

In some examples, the apparatus further includes an actuator for applying a transfer force on the single cone to urge the single cone past the escapement and into position in the respective cavity. In some examples, the actuator comprises a vacuum source in fluid communication with the escapement via the cavity, the vacuum source applying the transfer force in the form of suction. In some examples, each cavity includes an open lower end opposite the open upper end, and the vacuum source is in fluid communication with the open lower end. In some examples, the frame includes a housing having a chamber for providing fluid communication between the vacuum source and the open lower end of each cavity.

In some examples, the apparatus includes transfer automation adjacent the frame for transferring an empty pallet onto the frame and transferring a loaded pallet off the frame. In some examples, the transfer automation includes a conveyor having an upstream conveyor section for pallet transfer to toward the frame, a downstream conveyor section for pallet transfer away from the frame, or both an upstream and downstream conveyor section. In some examples, the transfer automation can alternately or additionally include a Cartesian robot with two or more linear axes, an articulating robot, a delta robot, and/or a SCARA robot.

In some examples, the apparatus includes a lift supporting the magazine, the lift operable to vertically translate the magazine relative to the frame between a raised position for facilitating movement of the pallet into and out from the frame, and a lowered position for engagement between the magazine and the pallet to facilitate transfer of the cones to each cavity via the transfer force.

According to some aspects, a cone staging apparatus for production of smoking articles includes: (a) a frame; (b) a cone pallet releasably supported by the frame, the cone pallet including a plurality of cavities, each cavity having an open upper end for receiving a cone therein; and (c) a cone magazine disposed above the cone pallet. The cone magazine includes a plurality of tubes. Each tube holds a stack of the cones. The magazine further includes an escapement at a lower end of each tube for dispensing the cones one-by-one from a bottom of the stack. Each escapement is in alignment with an open upper end of a respective cavity. The apparatus further includes (d) a vacuum source in fluid communication with the escapements through respective cavities for applying a suction force to draw the bottom-most cone from each stack through the escapements and into the respective cavities.

According to some aspects, a method for production of smoking articles includes: (a) positioning a first pallet under a cone magazine. The first pallet has a plurality of first cavities and the cone magazine holds a supply of cones. The method further includes (b) applying a suction force through each of the first cavities to draw a respective cone from the supply into each of the first cavities.

In some examples, the cone magazine includes a plurality of escapements. Each escapement is for dispensing the cones one-by-one from the supply. Step (a) includes aligning each escapement above an open upper end of a respective first cavity, and step (b) includes applying the suction force through each of the first cavities simultaneously for transferring a single cone through each escapement and into respective first cavities.

In some examples, the method further includes: removing the first pallet from under the cone magazine; positioning a second pallet under the cone magazine, the second pallet having a plurality of second cavities; and applying a suction force through each of the second cavities to draw a respective cone from the supply into each of the second cavities.

In some examples, the method further includes, after each first cavity has received a respective cone, filling each of the cones in the first pallet with an amount of smokeable product through an open upper end of each cone. In some examples, the method further includes, prior to the filling step, moving the first pallet from under the cone magazine to a cone filling station.

In some examples, the method further includes, after filling each of the cones, compacting the smokeable product in each of the cones. In some examples, the method further includes, prior to the compacting step, moving the first pallet to a compacting station.

In some examples, the method further includes, after filling each of the cones, twisting an upper portion of each cone to close the open upper end of each cone. In some examples, the method further includes, prior to the twisting step, moving the first pallet to a cone closure station.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION OF PREFERRED EMBODIMENT

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors, or owners do not intend to abandon, disclaim, or dedicate to the public any such invention by its disclosure in this document.

Figure 1:
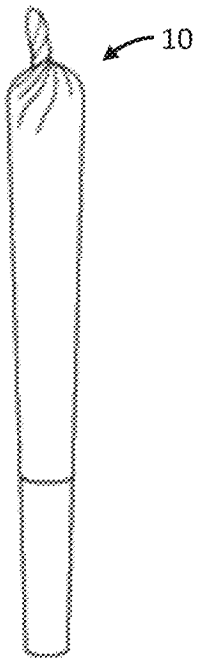
FIG. 1 is a perspective view of an example conical smoking article.

Smoking articles having a conical shape, like that of the example smoking article 10 shown in FIG. 1, are popular among a variety of users, including, for example, *cannabis* users. Smoking articles having a conical shape are typically hand-made, or otherwise produced in small, labor-intensive batches. In contrast, cylindrical smoking articles, such as traditional tobacco cigarettes, are often manufactured in high volume production systems with a high degree of sophisticated automation. But the difference in shape, among other reasons, can render the processes and apparatus of such automated systems inapplicable to conically shaped smoking articles such as the article 10.

Figure 2A:
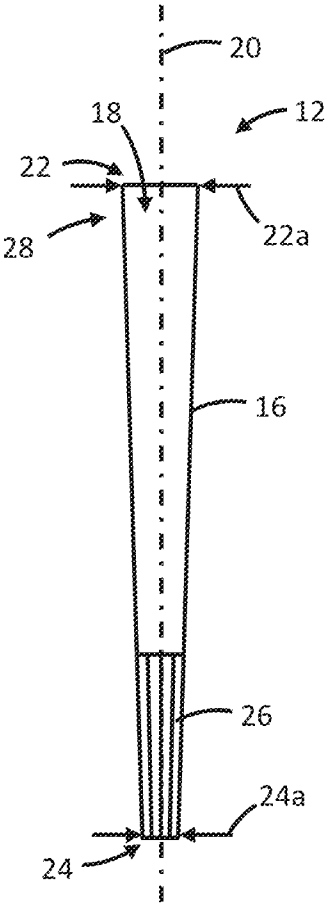
FIG. 2A is a cross-sectional view of the cone of FIG. 2, taken along line 2A-2A of FIG. 2.
Figure 2:
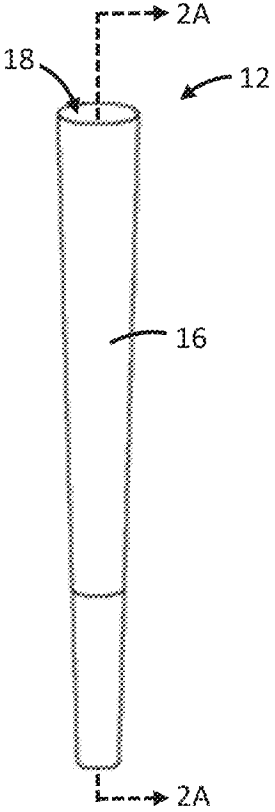
FIG. 2 is a perspective view of an example cone for manufacture of the smoking article of FIG. 1.

Referring to FIGS. 1 and 2, in the example illustrated, the example smoking article 10 is formed using a cone 12. The cone 12 is formed of a smokeable wrapper 16 having a cone cavity 18 for receiving and containing a smokeable product. In the example illustrated, the wrapper 16 is generally air impermeable, and the smokeable product is a granular product. In some examples, the cone 12 can be preassembled and the cone cavity 18 can be subsequently filled with the smokeable product. The smokeable product can be prepared via chopping, grinding, and/or sifting of a bulk smoking material. The bulk smoking material can include, for example, dried *cannabis* plant material, and the smokeable product can include *cannabis* granules.

Referring to FIG. 2A, in the example illustrated, the cone cavity 18 extends along a cone cavity axis 20 between an upper end 22 and a lower end 24 opposite the upper end 22. In the example illustrated, the wrapper 16 has an upper end diameter 22*a* at the upper end 22 of the cavity 18 and a lower end diameter 24*a* at the lower end 24 of the cavity 18. The lower end diameter 24*a* is smaller than the upper end diameter 22*a*, and the wrapper 16 tapers radially inwardly along the cavity axis 20 from the upper end diameter 22*a* to the lower end diameter 24*a* to provide the cone 12 with a generally conical shape. In the example illustrated in FIG. 2A, the upper end 22 of the cavity 18 is open for permitting filling of the cavity 18 with the smokeable product. In the example illustrated, the cone 12 includes a filter 26 in the cavity 18 adjacent the lower end 24. The filter 26 can help to provide structural stability to the smoking article 10, and can help inhibit smokeable product in the cavity 18 from escaping through the lower end 24.

Figure 3:
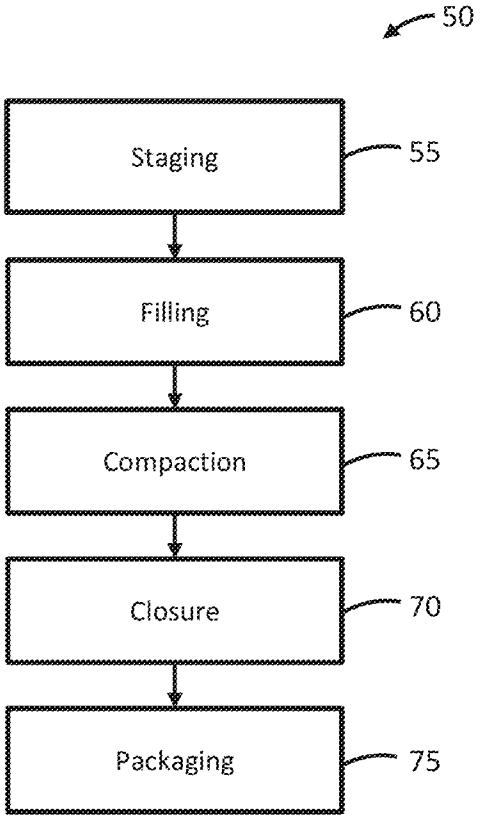
FIG. 3 is a flow chart showing an example process for production of conical smoking articles like that of FIG. 1.

Referring to FIG. 3, an example process 50 for production of conical smoking articles is shown, and will be described with respect to the example smoking article 10.

At step 55 of the process 50, a plurality of the cones 12 are staged for filling with the smokeable product. The cones 12 can be staged by, for example, being positioned in a pallet with the open upper ends 22 directed upwardly for receiving the smokeable product. The cones 12 can be staged using staging apparatuses and methods like those described in more detail below with respect to FIGS. 4 to 15.

At step 60, the staged cones 12 are filled with the smokeable product through respective open upper ends 22 of each cone 12. The cones 12 can be filled while held in the pallet.

At step 65, the smokeable product in the cones 12 is compacted. The smokeable product can be compacted while the cones 12 are held in the pallet.

At step 70, in the example illustrated, an upper portion 28 of each wrapper 16 is twisted to close the upper end 22 of the cavity 18 for inhibiting the smokeable product from escaping from the cavity 18, and to form the smoking article 10. At step 75, the smoking articles 10 can be packaged for shipment and/or sale.

Figure 4:
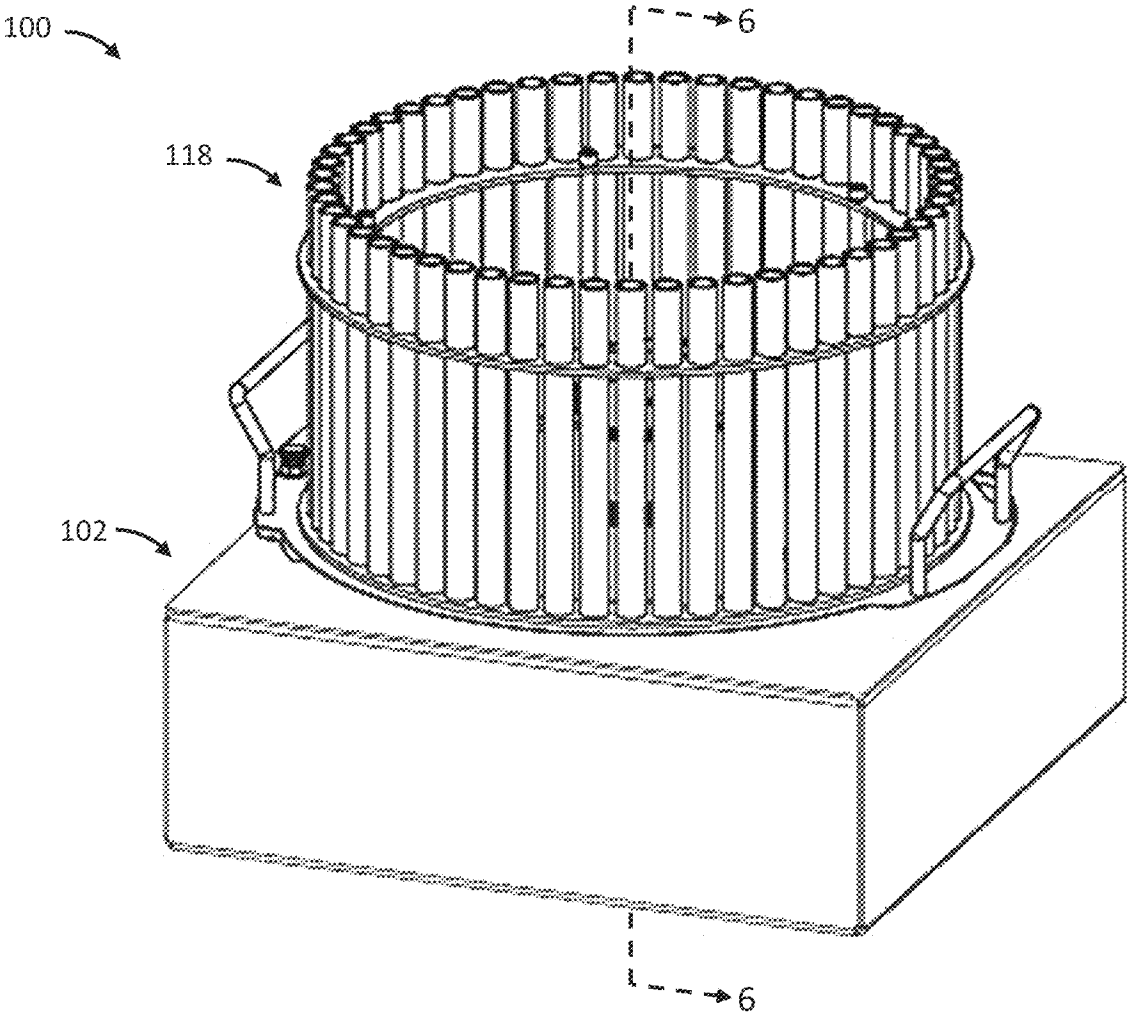
FIG. 4 is a perspective view of an example cone staging apparatus for use with the process of FIG. 3.

Referring to FIG. 4, an example cone staging apparatus 100 for use during the cone staging step 55 is shown, and will be described with respect to the example cone 12 of FIG. 2.

Figure 5:
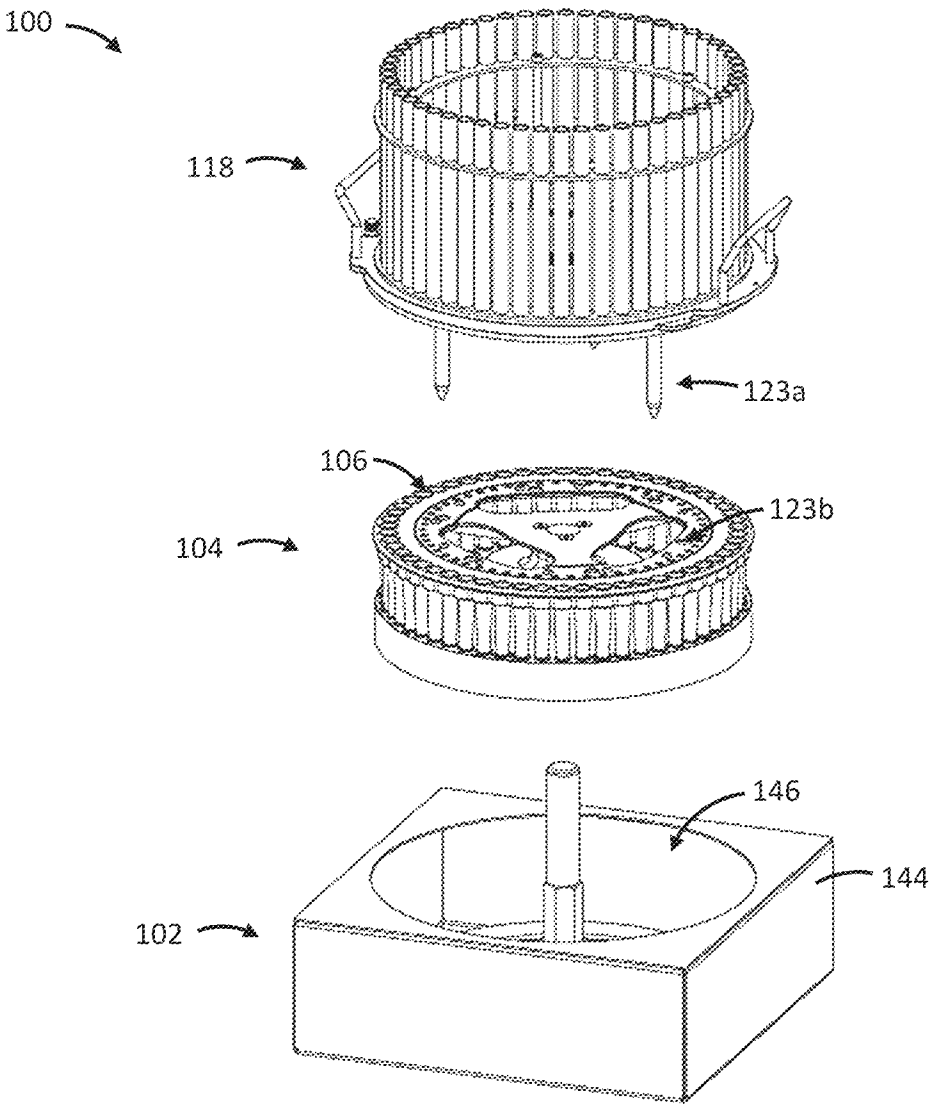
FIG. 5 is a partially exploded view of the cone staging apparatus of FIG. 4.

Referring also to FIG. 5, in the example illustrated, the apparatus 100 includes a frame 102 and a cone pallet 104 releasably supported by the frame 102. The cone pallet 104 includes a plurality of pallet cavities 106. The plurality of cavities 106 are, in the example illustrated, arranged in a geometric pattern, such as, in the example illustrated, a circular array. Other geometric patterns can also be used, for example, a rectangular array or grid.

Figure 6:
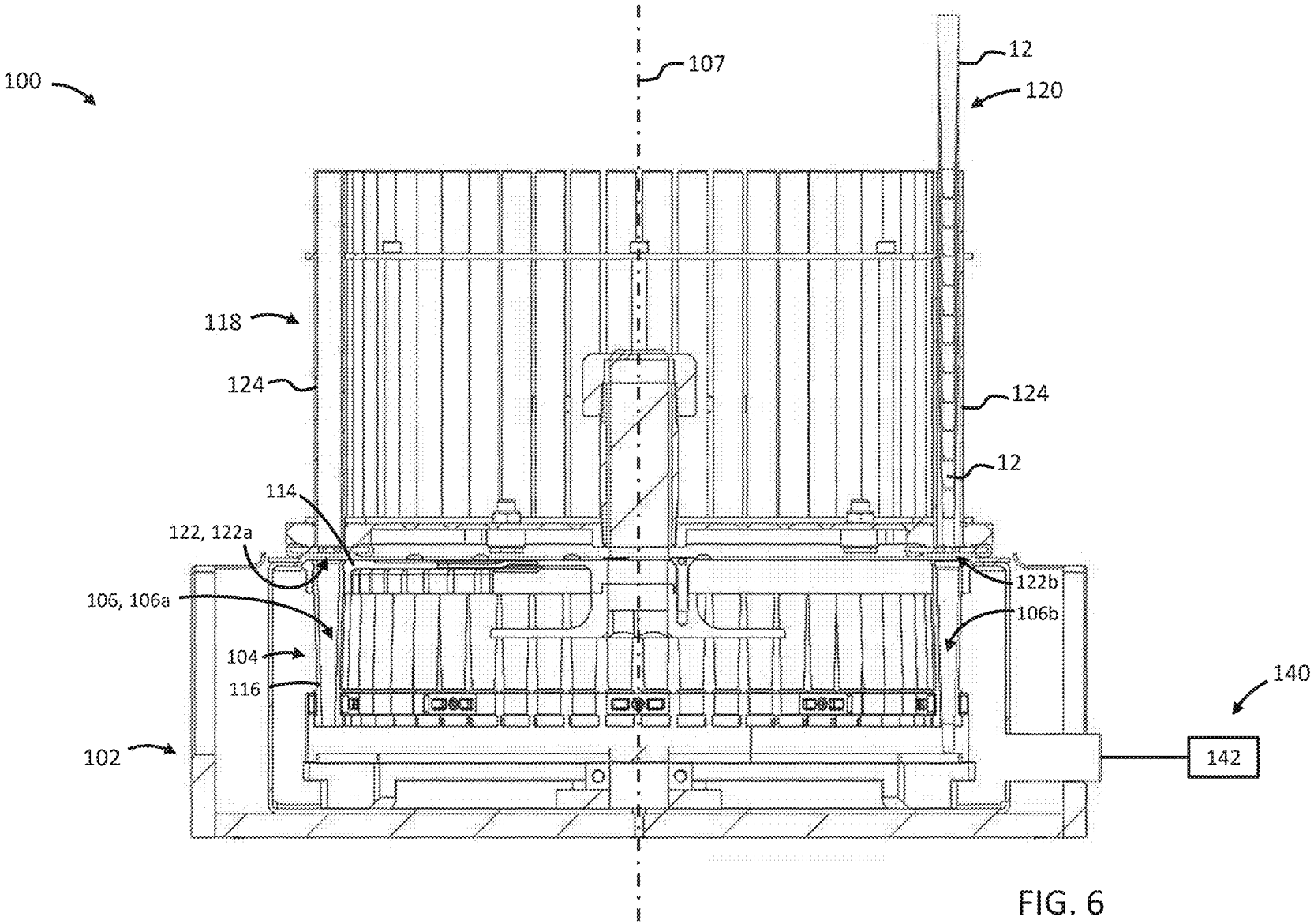
FIG. 6 is a cross-sectional view of the cone staging apparatus of FIG. 4, taken along line 6-6 of FIG. 4.
Figure 7C:
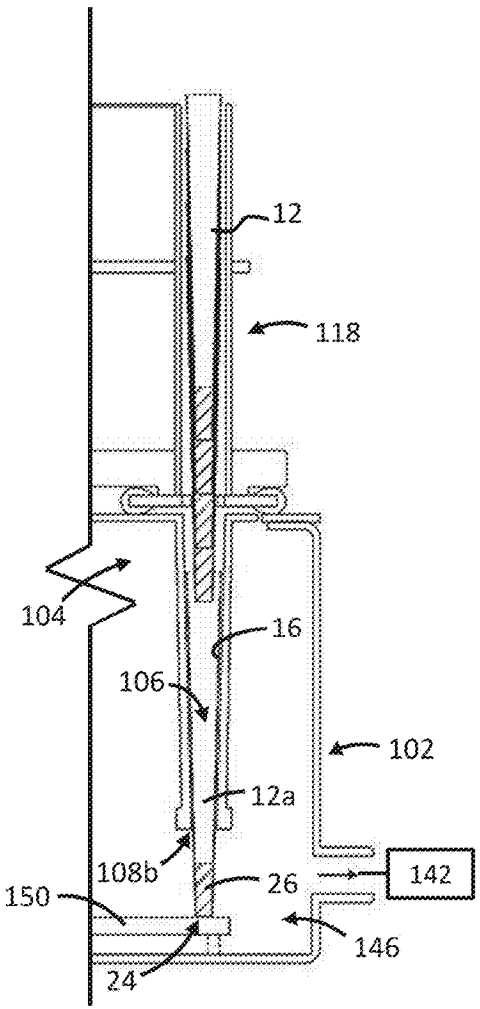
FIG. 7C is a schematic view like that of FIG. 7B, but with a cone transferred to a pallet cavity of the pallet portion.
Figure 7B:
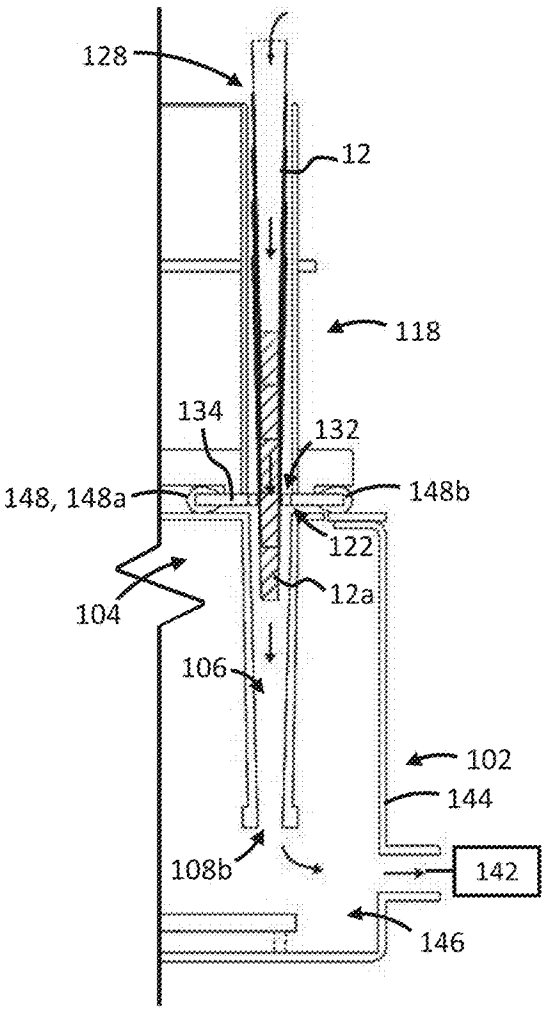
FIG. 7B is a schematic view like that of FIG. 7A, but showing the magazine portion in engagement with a pallet portion of the apparatus.
Figure 7A:
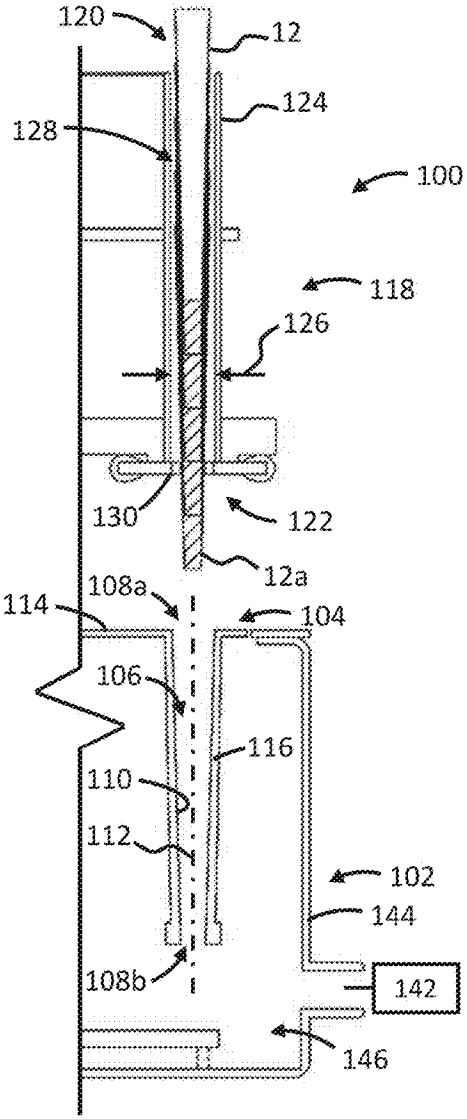
FIG. 7A is a schematic view of a portion of FIG. 6, showing a magazine portion of the apparatus in a raised position and holding a supply of cones.

Referring to FIG. 7A, each pallet cavity 106 has an open upper end 108*a* for receiving a respective cone 12. In the example illustrated, each pallet cavity 106 is defined by an inner surface 110 extending along a pallet cavity axis 112 between the upper end 108*a* and a lower end 108*b* opposite the upper end 108*a*. In the example illustrated, the inner surface 110 tapers radially inwardly along the axis 112 from the upper end 108*a* toward the lower end 108*b* to provide the inner surface 110 with a generally conical shape corresponding to that of at least a portion of the cone 12. In the example illustrated, the pallet 104 has a pallet body 114, and the pallet cavities 106 are provided in respective nests 116 attached to the pallet body 114. In the schematic example of FIG. 7A, the nests 116 are shown as being of unitary, integral, one-piece construction with the pallet body 114. In some examples, the nests 116 can be removably secured to the pallet body 114 (see e.g. FIG. 6). In some embodiments the removable nests allow for reconfiguration, where they are replaceable to allow the use of larger, smaller or differently shaped cones.

Still Referring to FIG. 7A, in the example illustrated, the apparatus 100 further includes a cone magazine 118 adjacent the frame 102 for holding a cone supply 120 of the cones 12. In the example illustrated, the cone magazine 118 includes at least one escapement 122 alignable over the open upper end 108*a* of a respective pallet cavity 106 of the cone pallet 104 to facilitate transferring a single cone 12 from the cone supply 120 to the respective pallet cavity 106.

Referring to FIG. 6, in the example illustrated, the at least one escapement 122 includes at least a first escapement 122*a* and a second escapement 122*b*. The first and second escapements 122*a*, 122*b* are alignable simultaneously over the open upper ends 108*a* (FIG. 7A) of a first pallet cavity 106*a* and a second pallet cavity 106*b*, respectively, of the plurality of pallet cavities 106. In the example illustrated, the quantity of the escapements 122 is equal to the quantity of the pallet cavities 106 of the cone pallet 104. In the example illustrated, the magazine 118 has fifty-four (54) escapements 122, and the cone pallet 104 has fifty-four (54) pallet cavities 106. In the example illustrated, the pallet cavities 106 are arranged in a circular array about a central axis 107. In some examples, the quantity of escapements 122 can be fewer than the quantity of pallet cavities 106, and the cone pallet 104 can be movable relative to one or more escapements 122 to index the alignment of the escapements 122 with open upper ends 108*a* of respective pallet cavities 106.

In the example illustrated, the pallet 104 and the magazine 118 can include complementary alignment features for facilitating alignment of the escapements 122 with respective cavities 106. Referring to FIG. 5, in the example illustrated, the alignment features include a plurality of locating pins 123*a* extending downwardly from the magazine 118 for insertion into a plurality of complementary holes 123*b* in the pallet 104.

Referring to FIG. 7A, in the example illustrated, the single cone 12 is, prior to transfer, a lowermost cone 12*a* of the cone supply 120, and the escapement 122 is configured to apply a retaining force against the lowermost cone 12*a* to prevent unwanted release of the lowermost cone 12*s* from the supply 120.

In the example illustrated, the magazine 118 includes at least one tube 124 having a tube diameter 126 sized for slidably receiving a cone stack 128 of the cones 12 in sliding fit. In the example illustrated, the escapement 122 comprises at least one restricting member 130 protruding radially inwardly of the tube diameter 126 for engaging the lowermost cone 12*a* of the cone stack 128. In the example illustrated, the quantity of tubes 124 (and corresponding cone stacks 128 and escapements 122) is equal to the quantity of pallet cavities 106. In the example illustrated, the tubes 124 are arranged in a circular array about the central axis 107 (FIG. 6).

Figure 8A:
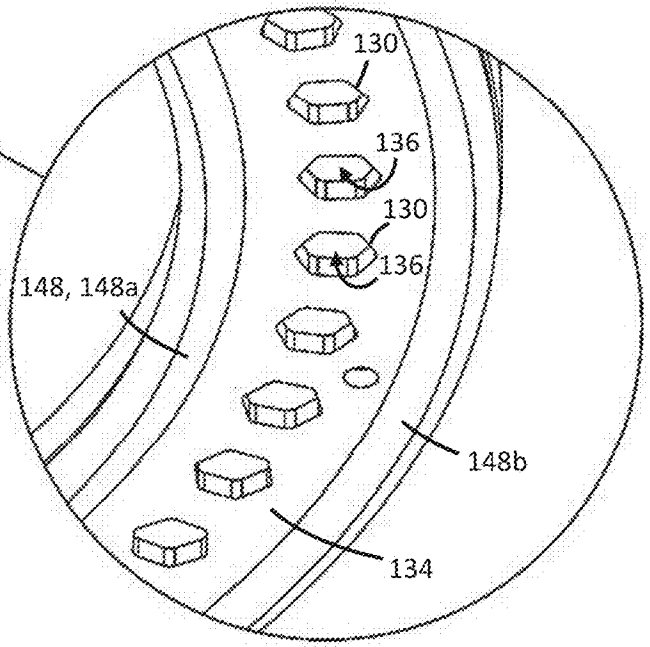
FIG. 8A is an enlarged view of a portion of FIG. 8.
Figure 8:
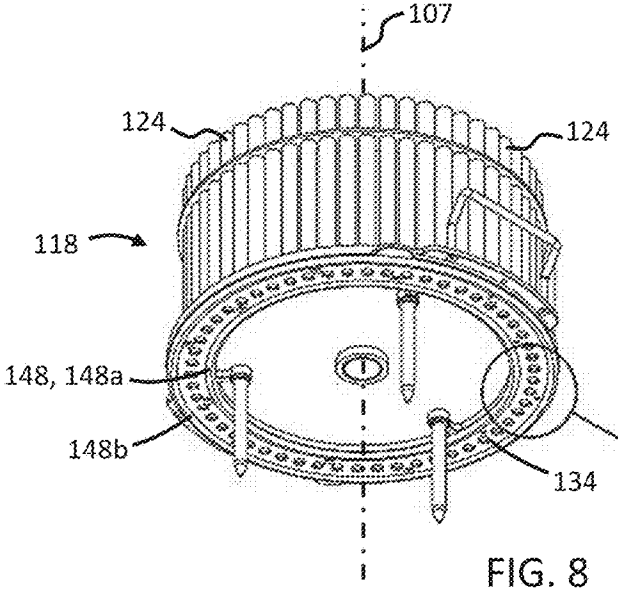
FIG. 8 is a bottom perspective view of a magazine portion of the apparatus of FIG. 4.

Referring to FIG. 7B, in the example illustrated, each tube 124 has an open lower end 132 for dispensing cones 12 from the cone stack 128. Referring to FIGS. 8 and 8A, in the example illustrated, the restricting members 130 comprise a restrictor plate 134 mounted below the lower ends of the tubes 124. In the example illustrated, the restrictor plate 134 is generally annular and extends about the central axis 107. The restrictor plate 134 has a plurality of apertures 136, and in use, each aperture 136 is in alignment with a respective open lower end of a tube 124 and with a respective open upper end 108*a* of a pallet cavity 106. In the example illustrated, each aperture 136 is sized and shaped to provide at least some resistance to passage of the cones 12 therethrough via friction and/or elastic deformation of the cones 12, to facilitate controlled one-by-one dispensing of the cones 12 from a respective tube 124 to a respective cavity 106.

In some examples, each aperture may be integral with the end of a respective tube 124. In some examples, the tube 124 may include an inner surface tapering radially inwardly toward the aperture to provide a smooth transition between the tube diameter 126 and the aperture size (e.g. the diameter of the aperture) to help guide the lower end of the cone 24 into the aperture.

Figure 8B:
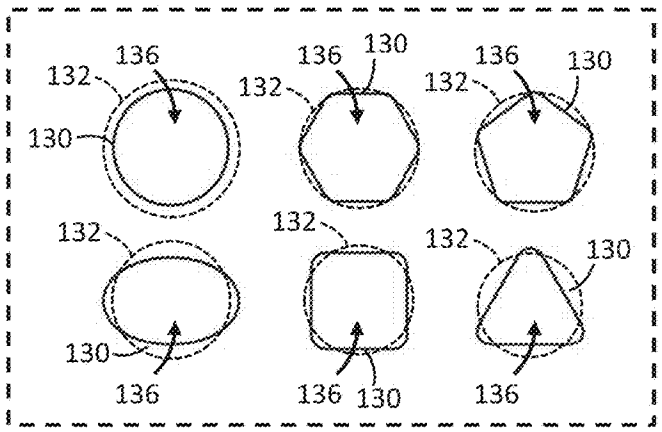
FIG. 8B are example aperture shapes for an escapement of the magazine portion of FIG. 8.

In the example shown in FIG. 8A, each aperture 136 has a generally hexagonal shape sized such that at least a portion of the plate 134 adjacent the aperture 136 protrudes radially inwardly of the tube diameter 126 for engaging an outer surface portion of a lowermost cone 12*a* of the cone stack 128 (FIG. 7A). In some examples, one or more of the apertures 136 may have a different shape, such as, for example, one of the shapes shown in FIG. 8B. For example, the apertures 136 may have a circular shape with a diameter that is concentric with and less than the tube diameter 126.

Referring to FIG. 6, in the example illustrated, the apparatus 100 includes an actuator 140 for applying a transfer force on the single cone 12 to urge the single cone 12 past the escapement 122 and into position in the respective pallet cavity 106. In the example illustrated, the actuator 140 comprises a vacuum source 142 in fluid communication with the escapement 122 via the pallet cavity 106. The vacuum source 142 is operable to apply the transfer force in the form of suction. Referring to FIG. 7A, in the example illustrated, the lower end 108*b* of each pallet cavity 106 is open, and the vacuum source 142 is in fluid communication with the open lower end 108*b*.

In some examples, the actuator 140 may include a gripper mechanism for exerting at least a portion of the transfer force on the cone 12. In some examples, transfer of the cone 12 from the tube 124 and through the aperture can be facilitated by the gripper mechanism contacting the lower portion of the cone 12, and pulling the cone through the aperture 122 and into the cone pallet 104. The gripper mechanism can apply the portion of the transfer force via, for example, mechanical means of pinching or squeezing, and/or using suction grippers to pull and then release the cone into a respective pallet cavity 106.

Referring to FIG. 5, in the example illustrated, the frame 102 includes a housing 144 having a chamber 146. Referring to FIG. 7B, in the example illustrated, the chamber 146 provides fluid communication between the vacuum source 142 and the open lower end 108*b* of each pallet cavity 106. In the example illustrated, at least a portion of the pallet 104 is received in the chamber 146 when supported by the frame 102.

In the example illustrated, one or more seals 148 are provided between the magazine 118 and the pallet 104, between the magazine 118 and the frame 102, and/or between the pallet 104 and the frame 102 to facilitate sealed engagement therebetween for application of the transfer force (i.e. a suction force through the chamber 146 in the example illustrated). Referring to FIG. 8, in the example illustrated, the one or more seals 148 include a first annular seal 148*a* extending about the central axis 107 radially inward of the apertures 136 (and pallet cavities 106), and a second annular seal 148*b* extending about the central axis 107 radially outward of the apertures 136 (and pallet cavities 106). In some examples, sealed engagement between the pallet tray 104, housing 144, and/or restrictor plate 134 may be provided through a sufficiently close fit such that seals and/or gaskets between such components may be omitted.

Referring to FIG. 7B, in the example illustrated, the first annular seal 148*a* is fixed to a radially inner edge of the annular restrictor plate 134 and provides sealed engagement between a lower surface of the magazine 118 and an upper surface of the pallet 104 at a location radially inward of the open upper ends 108*a* of the pallet cavities 106. In the example illustrated, the second annular seal 148*b* is fixed to a radially outer edge of the restrictor plate 134 and provides sealed engagement between a lower surface of the magazine 118 and an upper surface of the frame 104 at a location radially outward of the open upper ends 108*a* of the pallet cavities 106.

Referring to FIG. 7C, when a cone 12 is transferred into a respective pallet cavity 106, further suction through that pallet cavity 106 can be inhibited to help prevent transfer of additional cones 12 into the pallet cavity 106. In the example illustrated, the frame 102 includes a platform 150 in the chamber 146 under the open lower ends 108*b* of each pallet cavity 106. When the cone 12*a* is transferred into a respective pallet cavity 106 (as shown in FIG. 7C), at least a portion of the wrapper 16 is in engagement with the inner surface 110 (FIG. 7A) of the pallet cavity 106, and the lower end 24 of the cone 12 is supported by and in engagement with the platform 150. This can help inhibit further suction through the loaded pallet cavity 106 by, for example, blocking air flow through the filter 26 of the cone 12 and the lower end 108*b* of the pallet cavity 106.

Figure 9:
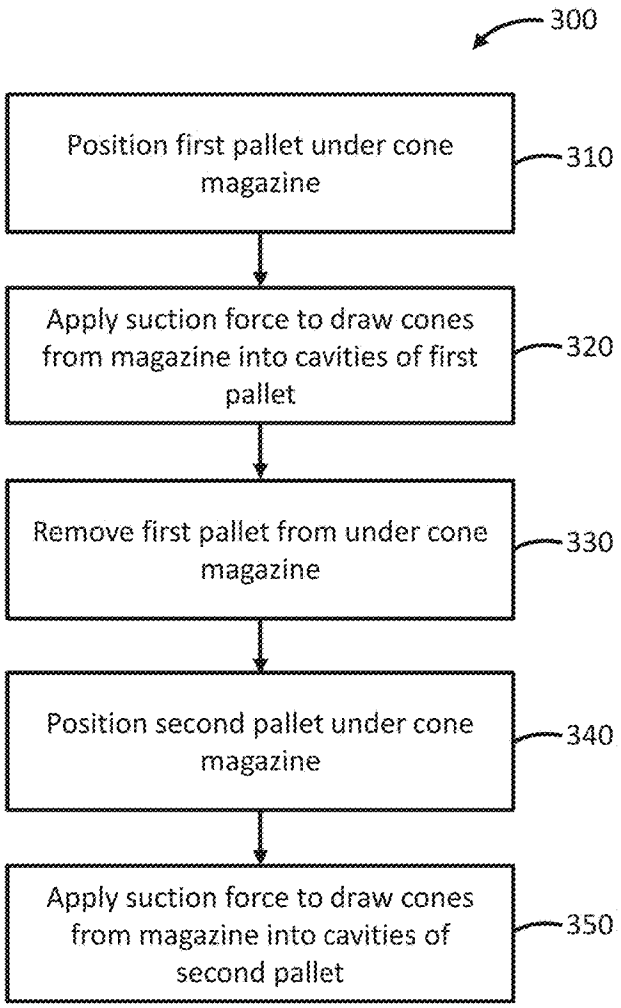
FIG. 9 is a flow chart showing an example process for production of conical smoking articles using an apparatus like that of FIG. 4.

Referring to FIG. 9, an example process 300 for production of smoking articles using the cone staging apparatus 100 is shown. At step 310 of the process 300, a first pallet 104 is positioned under the cone magazine 118. The first pallet 104 has a plurality of first cavities 106. Each escapement 122 can be aligned above an open upper end 108*a* of a respective first cavity 106.

At step 320, a suction force is applied through each of the first cavities 106 to draw a respective cone 12 from the supply 120 into each of the first cavities 106. The suction force can be applied through each of the first cavities 106 simultaneously for transferring a single cone through each escapement 122 and into respective first cavities 106. At step 330, the loaded first pallet 104 is removed from under the cone magazine 118.

After each first cavity 106 of the first pallet 104 has received a respective cone, the first pallet 104 can be moved from under the cone magazine 118 to a cone filling station to facilitate the filling step 60 of the process 50 (FIG. 3). At the cone filling station, each of the cones in the first pallet 104 can be filled with an amount of smokeable product through the open upper end of each cone. After each cone is filled, the first pallet 104 can be moved to a compacting station to facilitate the compacting step 65 of the process 50 (FIG. 3). At the compacting station, the smokeable product in each of the cones is compacted. After the smokeable product is compacted, the first pallet 104 can be moved to a cone closure station to facilitate the closing step 70 of the process 50 (FIG. 3). At the cone closure station, an upper portion of each cone is twisted to close the open upper end of each cone.

At step 340 of the process 300, after the first pallet 104 is removed from under the cone magazine 118, a second pallet 104 is positioned under the magazine 118. The second pallet 104 has a plurality of second cavities 106. At 350, a suction force is applied through each of the second cavities 106 to draw a respective cone from the supply 120 into each of the second cavities 106. After each second cavity 106 of the second pallet 104 has received a respective cone, the second pallet 104 can be moved from under the cone magazine 118 to the cone filling station, the compacting station, and the cone closure station to facilitate the filling, compacting, and closing steps 60, 65, and 70 of the process 50 (FIG. 3).

Figure 10:
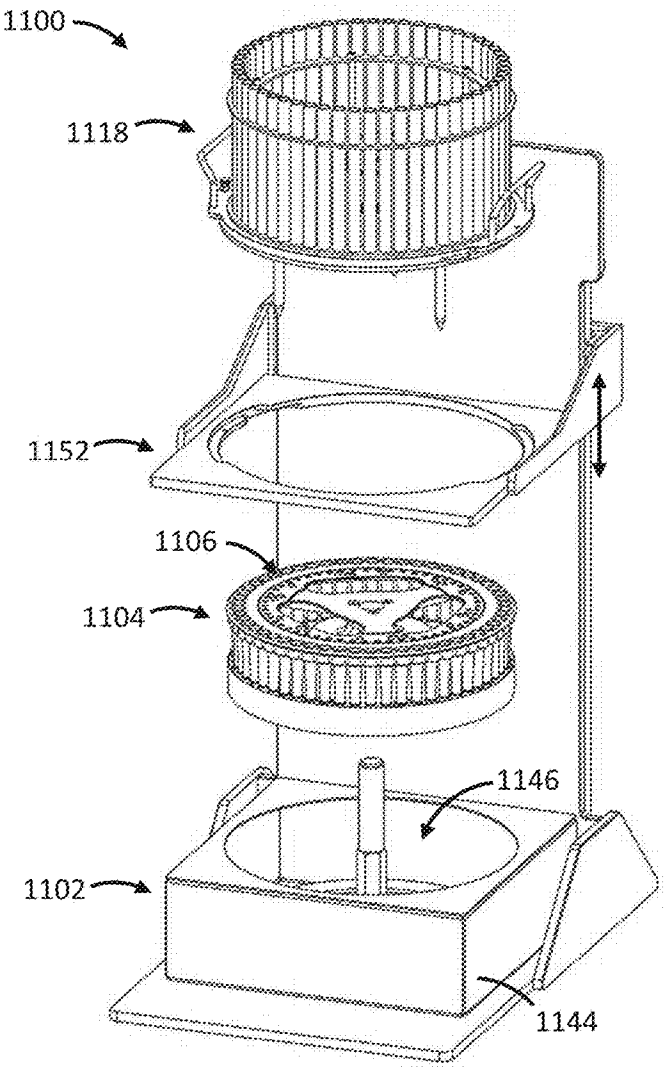
FIG. 10 is a partially exploded view of another example cone staging apparatus.

Referring to FIG. 10, another example cone staging apparatus 1100 is shown. The cone staging apparatus 1100 has similarities to the cone staging apparatus 100, and like features are identified with like reference characters, incremented by 1000.

In the example illustrated, the cone staging apparatus 1100 includes a frame 1102, a cone pallet 1104 supportable by the frame 1102 and having a plurality of pallet cavities 1106, and a cone magazine 1118 adjacent the frame 1102 for holding a supply of cones. In the example illustrated, the frame 1102 has a housing 1144 with a chamber 1146 for providing fluid communication between a vacuum source and open lower ends of each pallet cavity 1106. In the example illustrated, the pallet 1104 is received in the chamber 1146 when supported by the frame 1102.

In the example illustrated, the apparatus 1100 includes a lift 1152 for supporting the cone magazine 1118. The lift 1152 is operable to vertically translate the magazine 1118 relative to the frame 1102 between a raised position (shown in FIG. 10) and a lowered position. When the magazine 1118 is in the raised position, the magazine 1118 and the frame 1102 are spaced vertically apart for permitting movement of a pallet 1104 onto and off the frame 1102. When the magazine 1118 is in the lowered position, the magazine 1118 and a pallet 1104 on the frame 1102 are in engagement to facilitate transfer of the cones to each pallet cavity 1106 of the pallet 1104.

Figure 11:
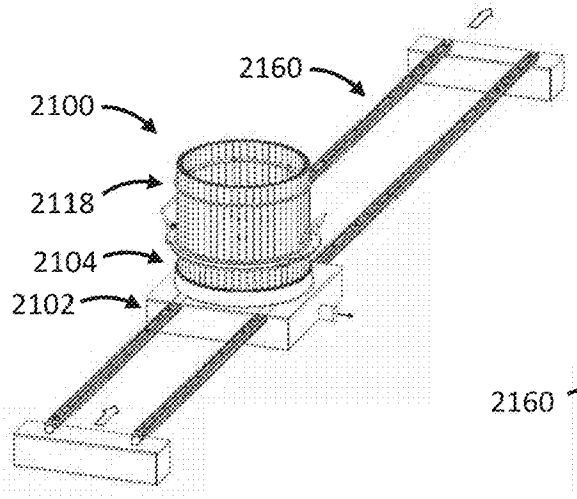
FIG. 11 is a perspective view of another example cone staging apparatus, showing a magazine portion of the apparatus in engagement with a pallet portion of the apparatus.

Referring to FIG. 11, another example cone staging apparatus 2100 is shown. The cone staging apparatus 2100 has similarities to the cone staging apparatus 100, and like features are identified with like reference characters, incremented by 2000.

Figure 13:
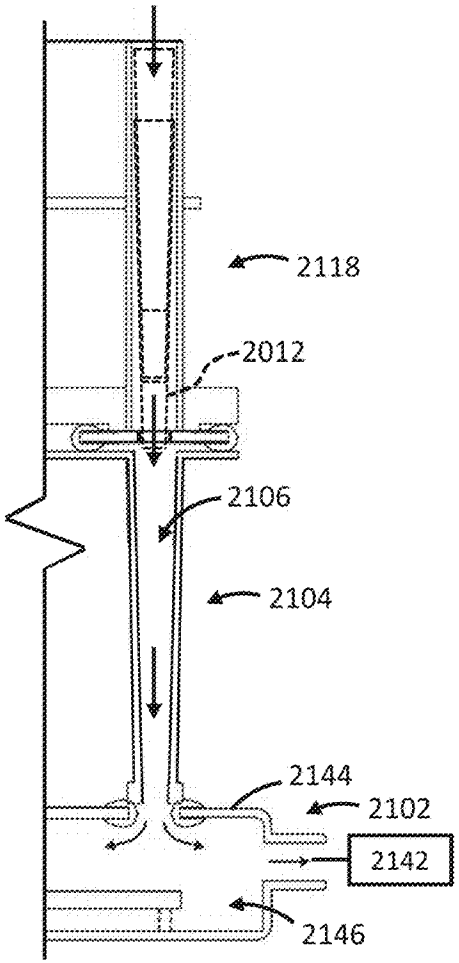
FIG. 13 is a schematic cross-sectional view like that of FIG. 7B, but of a portion of the cone staging apparatus of FIG. 11.

In the example illustrated, the cone staging apparatus 2100 includes a frame 2102, a cone pallet 2104 supportable by the frame 2102 and having a plurality of pallet cavities 2106 (FIG. 13), and a cone magazine 2118 adjacent the frame 2102 for holding a supply of cones 2012 (FIG. 13). In the example illustrated, the cone magazine 2118 is movable between a raised position (FIG. 12) for facilitating movement of a pallet 2104 onto and off the frame 2102, and a lowered position (FIGS. 11 and 13) for engagement with a pallet 2104 on the frame 2102. Referring to FIG. 13, in the example illustrated, the frame 2102 has a housing 2144 with a chamber 2146 for providing fluid communication between a vacuum source 2142 and open lower ends of each pallet cavity 2106. In the example illustrated, the pallet 2104 is positioned above the chamber 2146 and atop the housing 2144 when supported by the frame 2102.

Figure 12:
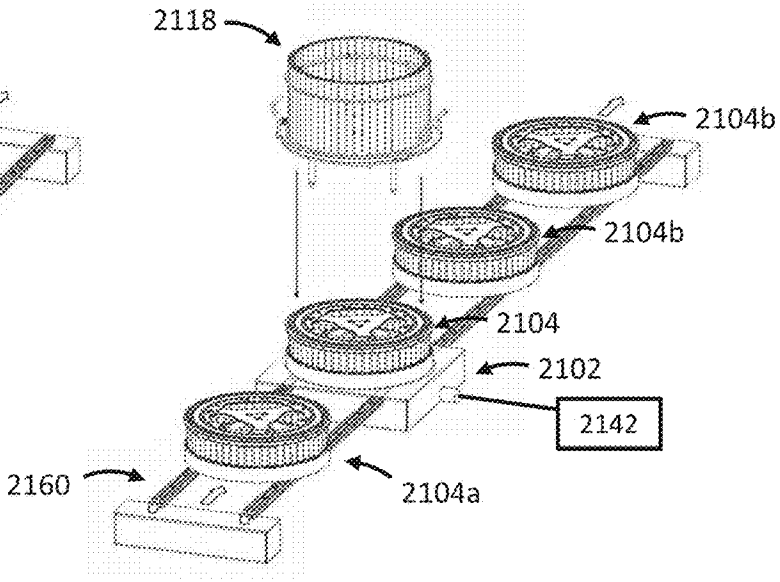
FIG. 12 is a perspective view like that of FIG. 11, but showing multiple pallet portions and the magazine portion in a raised position.

Referring to FIG. 12, in the example illustrated, the apparatus 2100 includes transfer automation adjacent the frame for transferring empty pallets 2104*a* onto the frame 2102 for engagement with the magazine 2118, and transferring loaded pallets 2104*b* off the frame 2102 for subsequent handling. In the example illustrated, the transfer automation includes a conveyor 2160 having an upstream conveyor section for transferring empty pallets toward the frame, and a downstream conveyor section for transferring loaded pallets away from the frame. In the example illustrated, the conveyor 2160 and the frame 2102 are arranged for conveying pallets 2104 horizontally, and vertically intermediate the magazine 2118 (when in the raised position) and the frame 2102. In some examples, the transfer automation can alternately or additionally include robotic devices, for example, a Cartesian robot with two or more linear axes, an articulating robot, a delta robot, and/or a SCARA robot.

Referring to FIG. 13, when an empty pallet 2104 is on the frame 2102, the magazine 2118 can be lowered into engagement with the empty pallet 2104, and a transfer force (i.e. a suction force in the example illustrated) can be applied for transferring cones 2012 from the magazine 2118 to the pallet cavities 2106. After one cone 2012 is transferred into each pallet cavity 2106, the magazine 2118 can be raised for conveying the loaded pallet 2104 off the frame 2102 via the conveyor 2160 for subsequent handling, and another empty pallet 2104 can be conveyed onto the frame 2102 via the conveyor 2160.

Figure 14:
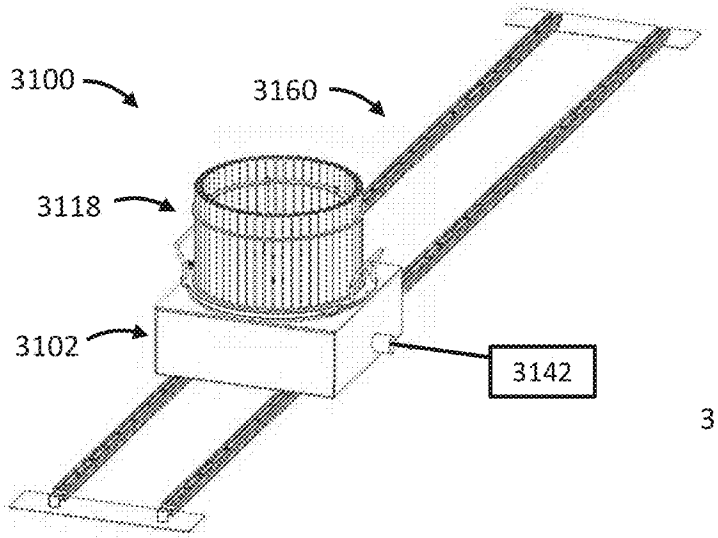
FIG. 14 is a perspective view of another example cone staging apparatus, showing a magazine portion of the apparatus in engagement with a pallet portion of the apparatus.

Referring to FIG. 14, in the example illustrated, another example cone staging apparatus 3100 is shown. The cone staging apparatus 3100 has similarities to the cone staging apparatus 100, and like features are identified with like reference characters, incremented by 3000.

Figure 15:
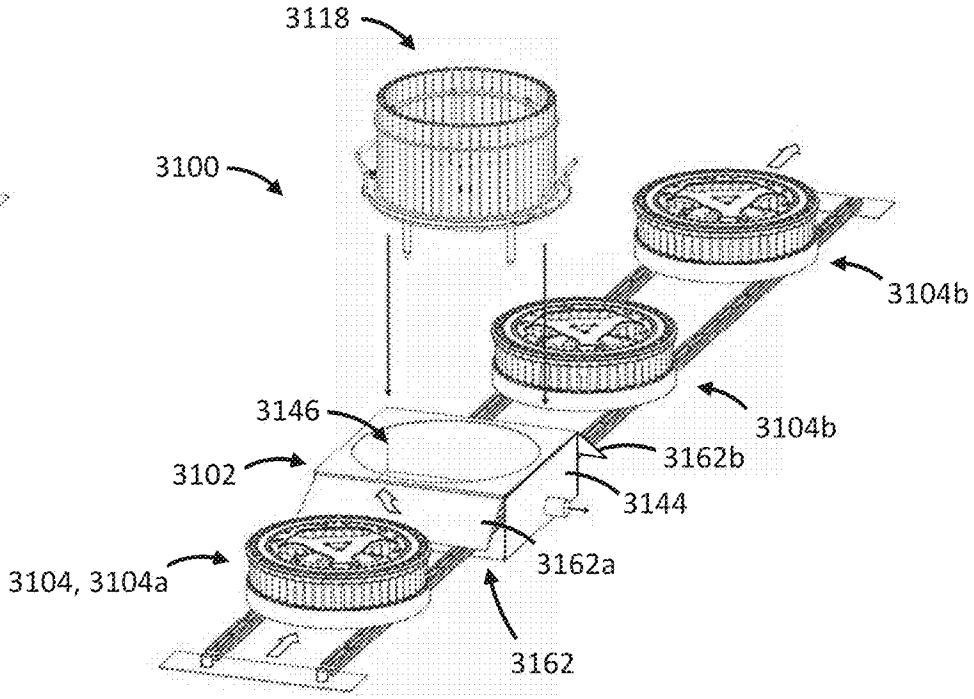
FIG. 15 is a perspective view like that of FIG. 14, but showing multiple pallet portions and the magazine portion in a raised position.

Referring to FIG. 15, in the example illustrated, the cone staging apparatus 3100 includes a frame 3102, a cone pallet 3104 supportable by the frame 3102 and having a plurality of pallet cavities, and a cone magazine 3118 adjacent the frame 3102 for holding a supply of cones. In the example illustrated, the cone magazine 3118 is movable between a raised position (FIG. 15) for facilitating movement of a pallet 3104 onto and off the frame 3102, and a lowered position (FIG. 14) for engagement with a pallet 3104 on the frame 3102. In the example illustrated, the frame 3102 has a housing 3144 with a chamber 3146 for providing fluid communication between a vacuum source 3142 (FIG. 14) and open lower ends of each pallet cavity. In the example illustrated, the pallet 3104 is received in the chamber 3146 when supported by the frame 3102.

In the example illustrated, the apparatus 3100 includes a conveyor 3160 adjacent the frame 3102 for conveying empty pallets 3104*a* onto the frame 3102 for engagement with the magazine 3118, and for conveying loaded pallets 3104*b* off the frame 3102. In the example illustrated, the frame 3102 has a door assembly 3162 to facilitate conveyance of pallets 3104 into and out from the chamber 3146. In the example illustrated, the door assembly is movable between an open position for conveying pallets 3104 into and out from the chamber 3146 via the conveyor 3160, and a closed position to facilitate sealing of the chamber 3146 during application of a suction force for transferring cones from the magazine 3118 to empty pallet cavities. In the example illustrated, the door assembly includes an entrance door 3162*a* on a first side of the frame 3102 for conveying empty pallets 3104 into the chamber 3146, and an exit door 3162*b* on a second side of the frame 3102 opposite the first side for conveying loaded pallets 3104 out from the chamber 3146.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

The invention claimed is:

1. A cone staging apparatus for production of smoking articles, comprising:

a. a frame;

b. a cone pallet releasably supported by the frame, the cone pallet including a plurality of cavities, each cavity having an open upper end for receiving a cone therein; and c. a cone magazine adjacent the frame for holding a plurality of stacks of cones, the cone magazine including a plurality of escapements, each escapement configured for dispensing the cones from a respective stack of cones, each escapement being alignable over the open upper end of a respective cavity of the cone pallet when the cone magazine is positioned above the cone pallet to facilitate transferring a single cone from the respective stack of cones through the escapement downward to the respective cavity, and wherein the plurality of escapements are configured so that the cones transferred through the respective escapements all move in the same direction through the respective escapements downward to the respective cavities.

2. The apparatus of claim 1, wherein the plurality of escapements includes a first escapement and a second escapement, the first and second escapements alignable simultaneously over the open upper ends of a first cavity and a second cavity, respectively, of the plurality of cavities.

3. The apparatus of claim 1, wherein the quantity of the escapements is equal to the quantity of the cavities of the cone pallet.

4. The apparatus of claim 1, wherein the cavities are arranged in a circular array.

5. The apparatus of claim 1, wherein the pallet comprises a pallet body, and the cavities are of unitary, integral construction with the pallet body.

6. The apparatus of claim 1, wherein the pallet comprises a pallet body, and each cavity is defined by an inner surface of a respective nest, the nests removably secured to the pallet body.

7. The apparatus of claim 1, wherein the single cone from the respective stack of cones is, prior to transfer, a lowermost cone of the respective stack of cones, and each escapement is configured to apply a retaining force against the lowermost cone of the respective stack of cones to prevent unwanted release of the lowermost cone from the respective stack of cones.

8. The apparatus of claim 7, wherein the magazine comprises a plurality of tubes, each tube having a tube diameter sized for slidably receiving a respective stack of cones in sliding fit, wherein each escapement is positioned at a lower end of a respective tube, and wherein each escapement comprises at least one restricting member protruding radially inwardly of the tube diameter of the respective tube for engaging a lowermost cone of the respective stack of cones.

9. The apparatus of claim 7, further comprising an actuator for applying a transfer force on the single cone from the respective stack of cones to urge the single cone past the respective escapement and into position in the respective cavity.

10. The apparatus of claim 9, wherein the actuator comprises a vacuum source in fluid communication with each escapement via the respective cavity aligned with the escapement when the cone magazine is positioned above the cone pallet, the vacuum source applying the transfer force in the form of suction.

11. The apparatus of claim 10, wherein each cavity includes an open lower end opposite the open upper end, and wherein the vacuum source is in fluid communication with the open lower end.

12. The apparatus of claim 11, wherein the frame comprises a housing having a chamber for providing fluid communication between the vacuum source and the open lower end of each cavity.

13. The apparatus of claim 1, further comprising transfer automation adjacent the frame for transferring an empty pallet onto the frame and transferring a loaded pallet off the frame.

14. The apparatus of claim 1, further comprising a lift supporting the magazine, the lift operable to vertically translate the magazine relative to the frame between a raised position for facilitating movement of the pallet into and out from the frame, and a lowered position for engagement between the magazine and the pallet to facilitate transfer of the cones to each cavity via a transfer force.

15. The apparatus of claim 1, further comprising at least one of a conveyor, a robotic device, a Cartesian robot with two or more linear axes, an articulating robot, a delta robot, or a SCARA robot, the at least one conveyor, robotic device, Cartesian robot, articulating robot, delta robot, or SCARA robot adjacent the frame and configured to transfer an empty pallet onto the frame and transfer a loaded pallet off the frame.

16. A cone staging apparatus for production of smoking articles, comprising:

a. a frame;

b. a cone pallet releasably supported by the frame, the cone pallet including a plurality of cavities, each cavity having an open upper end for receiving a cone therein; and c. a cone magazine disposed above the cone pallet, the cone magazine including a plurality of tubes, each tube for holding a stack of the cones, the magazine further including a plurality of escapements each at a lower end of a respective tube for dispensing the cones one-by-one from a bottom of a respective stack, each escapement in alignment with an open upper end of a respective cavity; and d. a vacuum source in fluid communication with the escapements through respective cavities for applying a suction force to draw the bottom-most cone from each stack downward through the escapements and into the respective cavities, and wherein the plurality of escapements are configured so that the cones drawn from each of the respective stacks all move in the same direction through the respective escapements downward and into the respective cavities.

17. A cone staging apparatus for production of smoking articles, comprising:

a. a frame;

b. a cone pallet releasably supported by the frame, the cone pallet including a plurality of cavities, each cavity having an open upper end for receiving a cone therein;

c. a cone magazine adjacent the frame for holding a supply of cones, the cone magazine including at least one escapement alignable over the open upper end of a respective cavity of the cone pallet to facilitate transferring a single cone from the supply of cones to the respective cavity, wherein the single cone is, prior to transfer, a lowermost cone of the supply of cones, and the escapement is configured to apply a retaining force against the lowermost cone to prevent unwanted release of the lowermost cone from the supply of cones; and d. an actuator for applying a transfer force on the single cone to urge the single cone past the escapement and into position in the respective cavity, wherein the actuator comprises a vacuum source in fluid communication with the escapement via the respective cavity, the vacuum source applying the transfer force in the form of suction, wherein each cavity includes an open lower end opposite the open upper end, wherein the vacuum source is in fluid communication with the open lower end, and wherein the frame comprises a housing having a chamber for providing fluid communication between the vacuum source and the open lower end of each cavity.

* * * * *